United States Patent [19]

Craft et al.

[11] Patent Number: 4,457,054

[45] Date of Patent: Jul. 3, 1984

[54] CASKET SHELF

[75] Inventors: William K. Craft, Cincinnati, Ohio; Wilfrid J. Scheele, Batesville, Ind.

[73] Assignee: Batesville Casket Company, Inc., Batesville, Ind.

[21] Appl. No.: 375,666

[22] Filed: May 6, 1982

[51] Int. Cl.[3] ..... A61G 71/00

[52] U.S. Cl. ..... 27/1; 27/14

[58] Field of Search ..... 27/1, 14–18; 24/3 R, 3 B; 248/205 R, 214, 220.2, 311.2, 315

[56] References Cited

U.S. PATENT DOCUMENTS

| | | | |
|---|---|---|---|
| 443,209 | 12/1980 | Ripson | 27/15 |
| 2,140,663 | 12/1938 | Bailey | 248/220.2 |
| 3,077,016 | 2/1963 | White | 27/19 |
| 3,802,652 | 5/1974 | Holton | 248/315 |
| 4,312,104 | 1/1982 | Baker et al. | 27/19 |

*Primary Examiner*—Robert A. Hafer
*Assistant Examiner*—William H. Honaker
*Attorney, Agent, or Firm*—Burns, Doane, Swecker & Mathis

[57] ABSTRACT

A casket shelf is mounted on the upholstery of a casket lid. The shelf includes a retaining portion which fits into a slit formed into the upholstery to support the shelf in cantilever fashion. The shelf may include a planar support surface, or mutually inclined support surfaces for supporting objects such as a book.

6 Claims, 10 Drawing Figures

Fig. 1
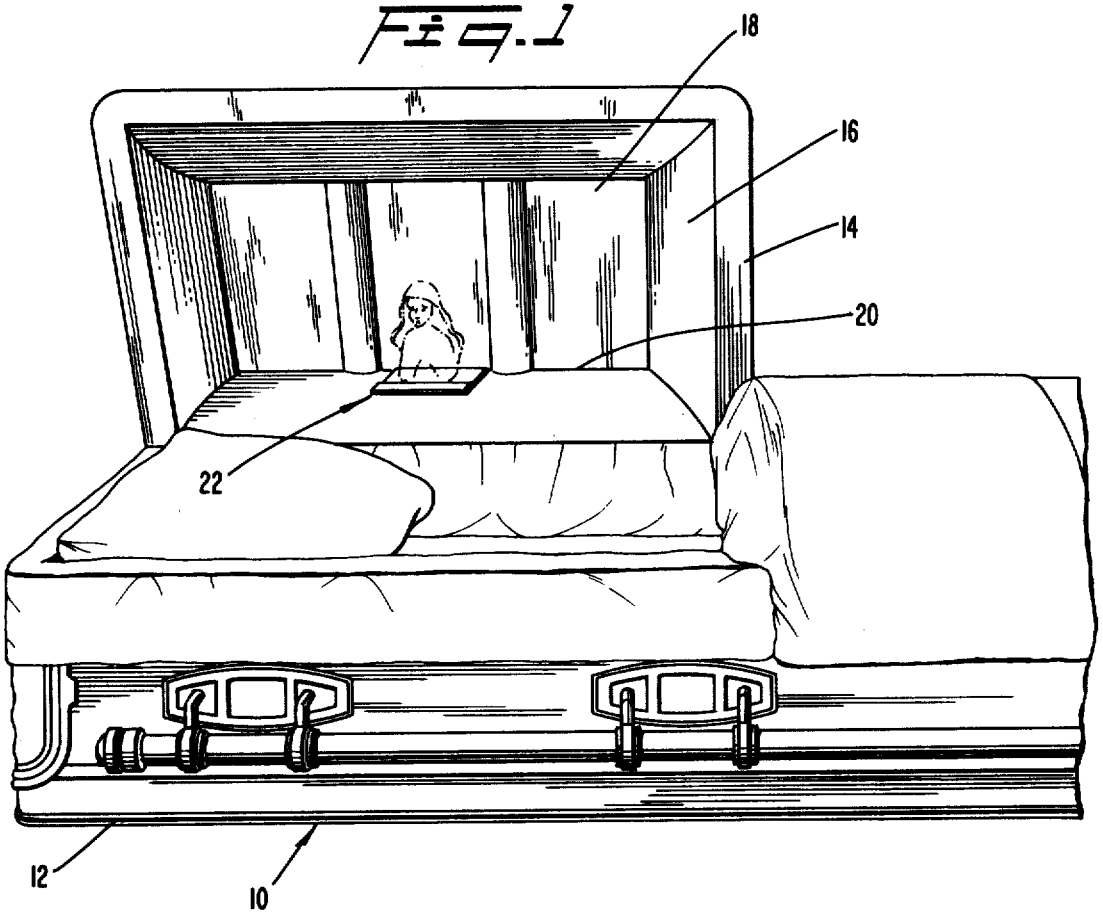
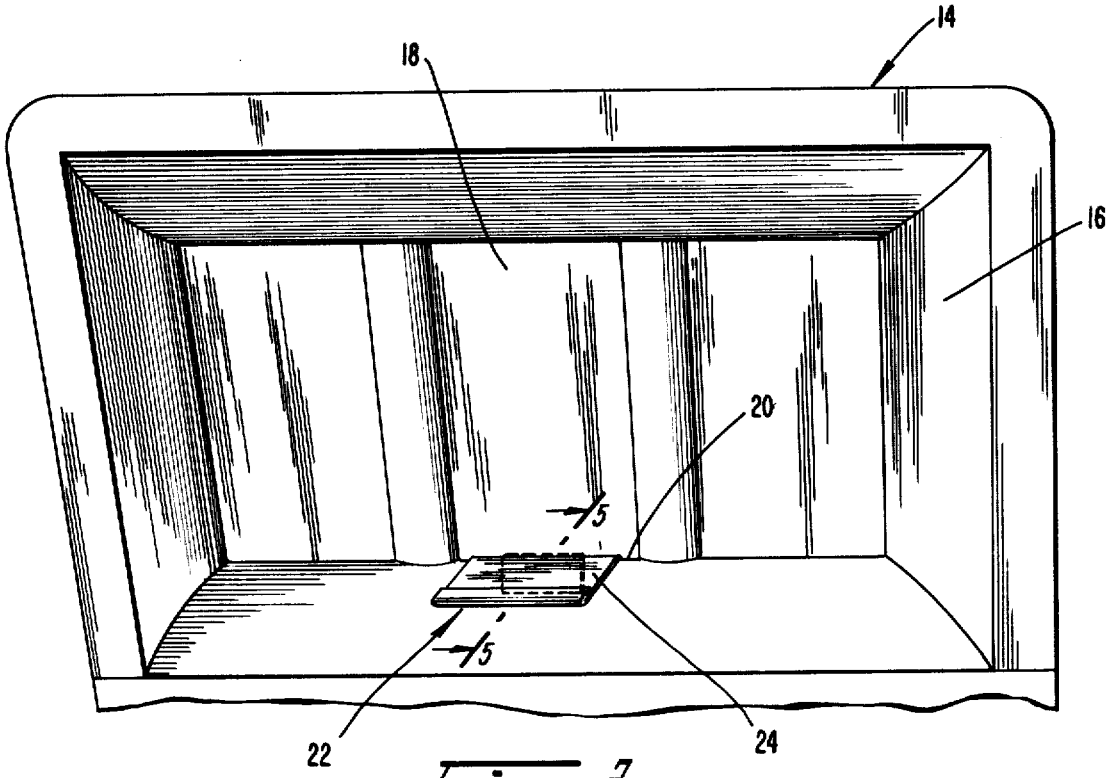
Fig. 2

Fig. 6
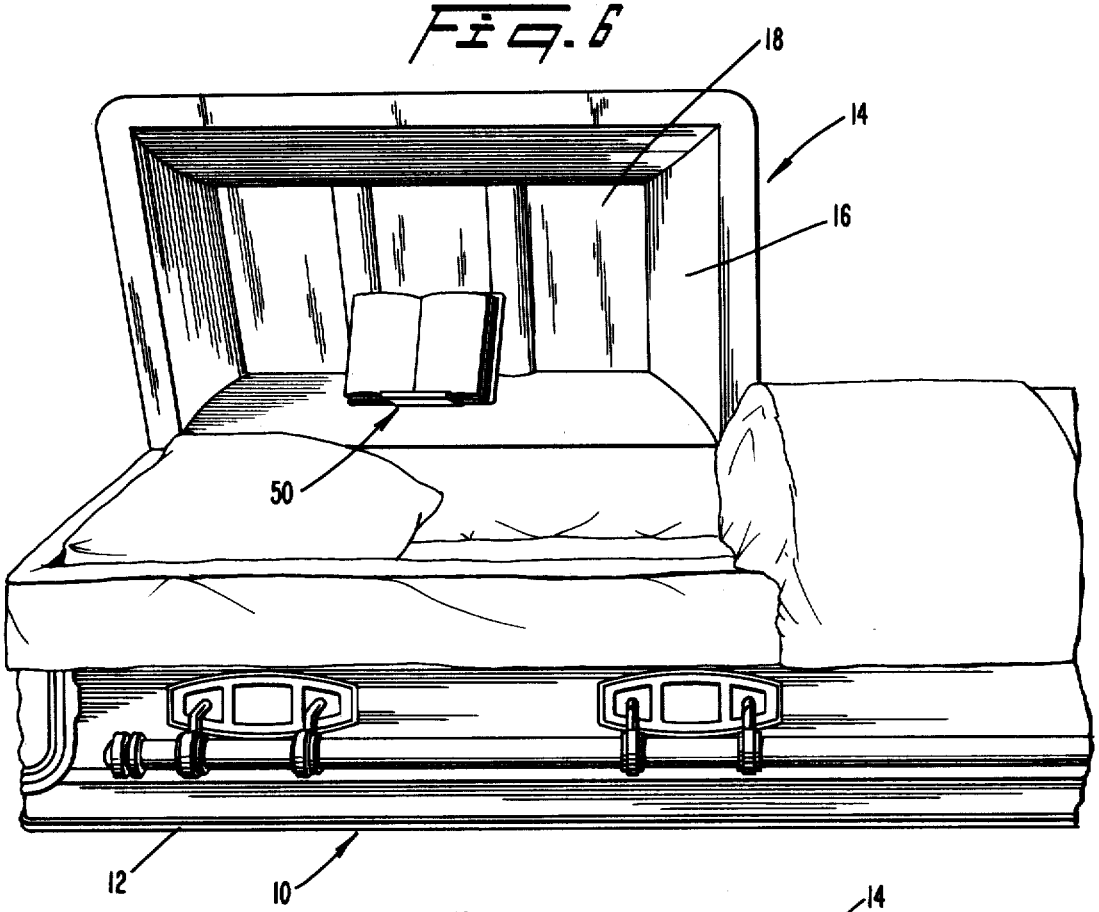
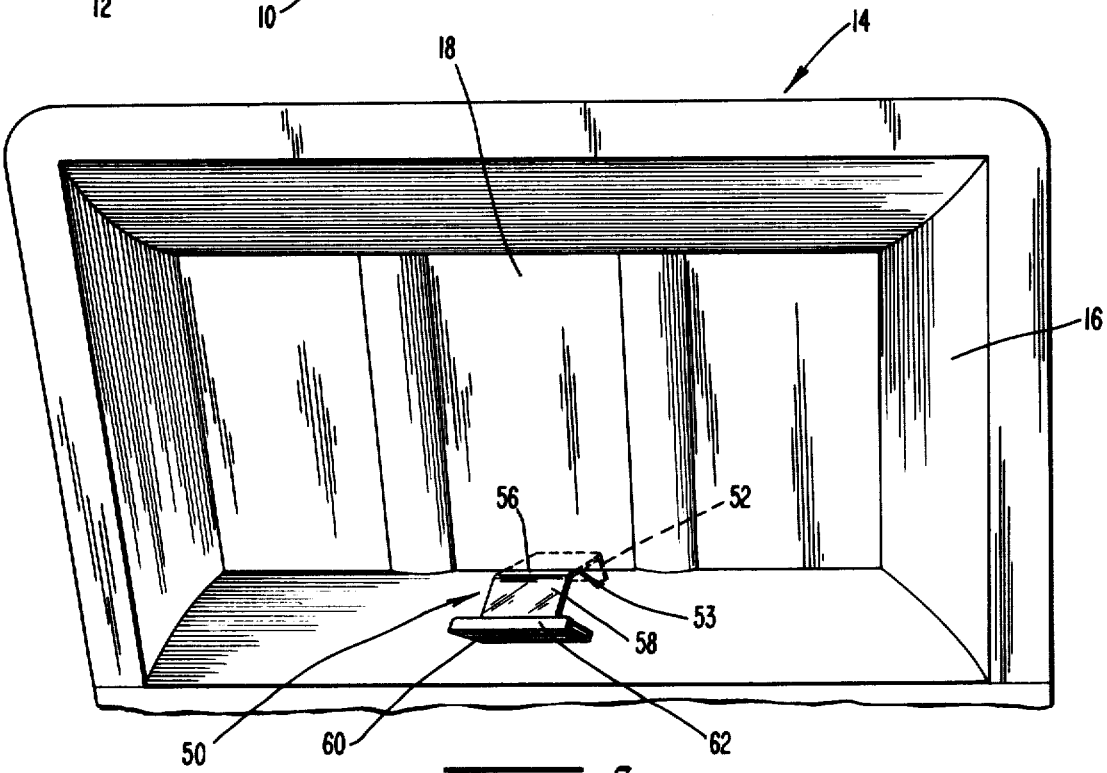
Fig. 7

CASKET SHELF

BACKGROUND AND OBJECTS OF THE INVENTION

The present invention relates to caskets and, in particular to a casket/shelf combination.

When a casket is opened to permit the viewing of a deceased, articles having a religious or personal significance are often placed alongside the casket. For example, statues, photographs, bibles and other objects and memorabilia might be placed around the casket.

The present invention enables such articles to be placed immediately adjacent the deceased and within the casket itself to create a more intimate, less cluttered atmosphere.

SUMMARY OF THE INVENTION

The present invention relates to a casket shelf, the casket being of the type comprising a container and a lid hinged thereto. The lid has stiff upholstery mounted on the inside surface of the lid, which upholstery forms a slit. The shelf is removably attachable within the upholstery in cantilever fashion. The shelf comprises a support portion and a retaining portion. The support portion includes a support surface for supporting an article. The retaining portion extends at an angle relative to an adjoining section of the support portion. The retaining portion is sized to fit through the slit in the upholstery and lie behind a section of the upholstery to stabilize the shelf against movement.

The support portion may include a planar surface for supporting an article such as a statue. Alternatively, the support portion may include mutually angled sections for supporting a book in an opened condition.

Preferably, the retaining portion extends downwardly, with the slit being defined by a seam between adjacent sections of the upholstery.

THE DRAWING

The objects and advantages of the invention will become apparent from the following detailed description of preferred embodiments thereof, in connection with the accompanying drawings in which like numerals designate like elements, and in which:

FIG. 1 is a perspective view of a casket having a head section of the lid opened, and with a casket shelf according to the present invention mounted on the upholstery of the casket lid;

FIG. 2 is a front view of the casket lid, with the casket shelf being empty;

FIG. 6 is a view similar to FIG. 1, depicting a different type of casket shelf according to the present invention which supports a book in an opened condition;

FIG. 7 is a view similar to FIG. 2, depicting the casket shelf of FIG. 6;

DETAILED DESCRIPTION OF PREFERRED EMBODIMENTS OF THE INVENTION

Figure 3:
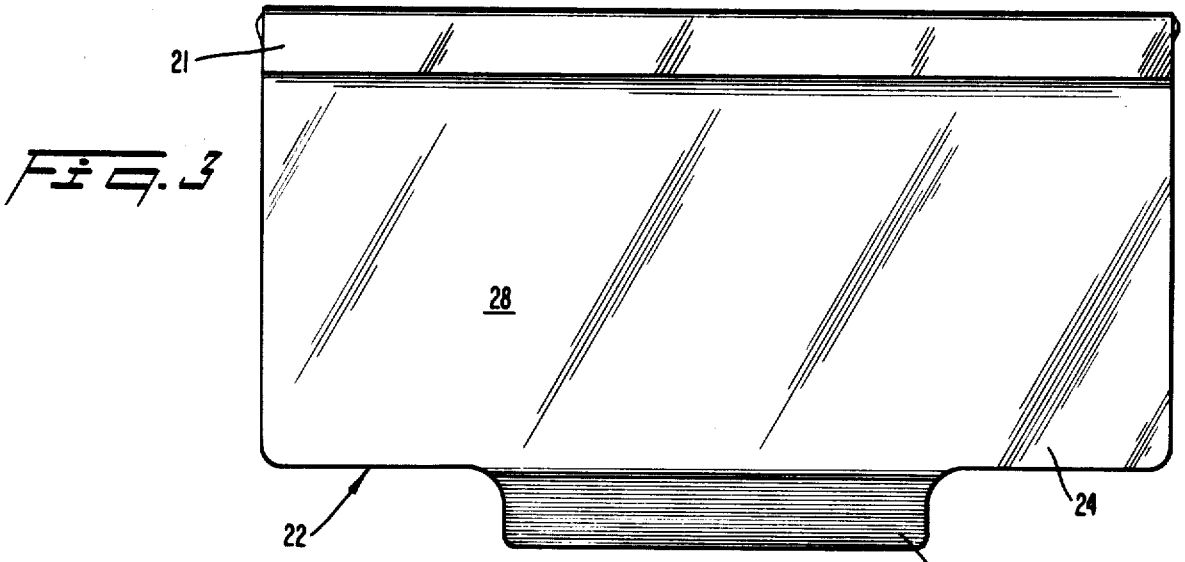
FIG. 3 is a plan view of a casket shelf.
Figure 4:
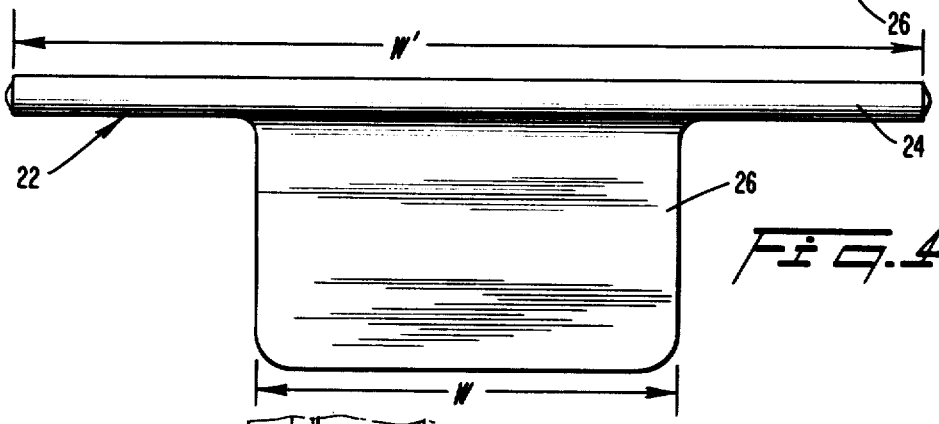
FIG. 4 is an end view of a casket shelf.

In accordance with the present invention, there is provided a shelf which is configured in accordance with a casket interior to provide an easily installable and removable support for positioning articles within the casket itself.

A conventional casket 10 comprises a container portion 12 and a hinged lid 14 which may be retained in an open position to permit viewing of the deceased. Typically, the interior of the lid 14 is lined with a stiff decorative upholstery of some sort. Such upholstery may comprise a frame or "puffing" 16 which borders one or more interior stiff panels 18. The frame 16 and panel 18 may each comprise a backing of cardboard to which a fabric is mounted, and may be installed by securing the frame to the lid interior and then inserting the panel, as by means of staples, or by a friction fit in the manner disclosed in copending Application Ser. No. 254,085 of Charles Winburn et al filed Apr. 14, 1981. As a result, one or more seams 20 are formed at the interface or adjoining edges of the frame and panel, the seam constituting a slit.

In accordance with the present invention, a shelf 22 cooperates with such a casket structure to support articles of religious or personal significance, for example, directly adjacent the deceased and within the confines of the casket itself.

Figure 5:
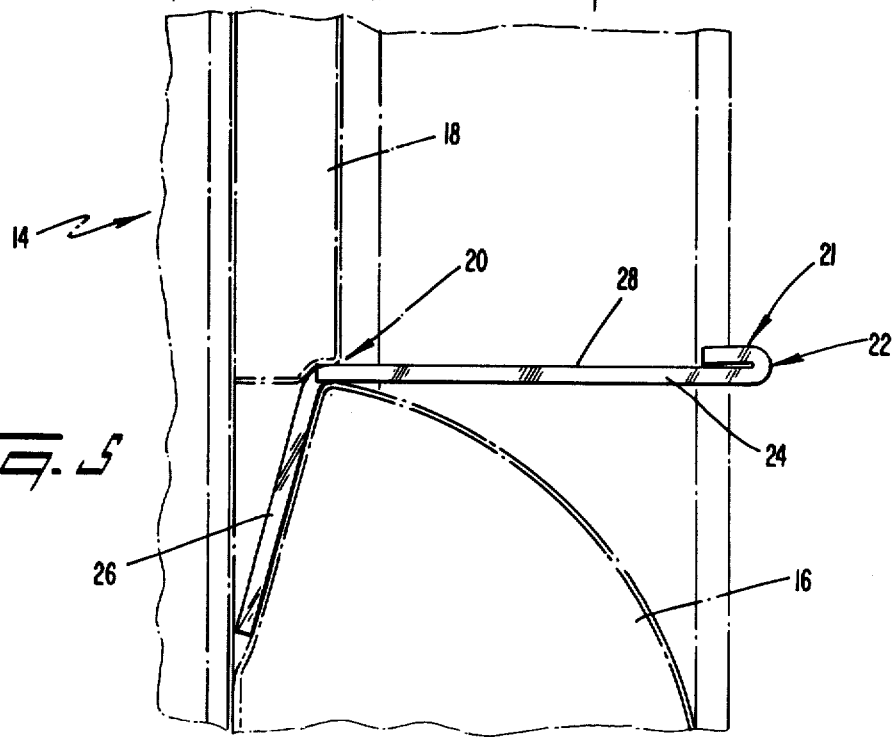
FIG. 5 is a cross-sectional view taken through the casket lid along line 5—5 in FIG. 2 and depicting the cantilever mounting of the shelf.
Figure 8:
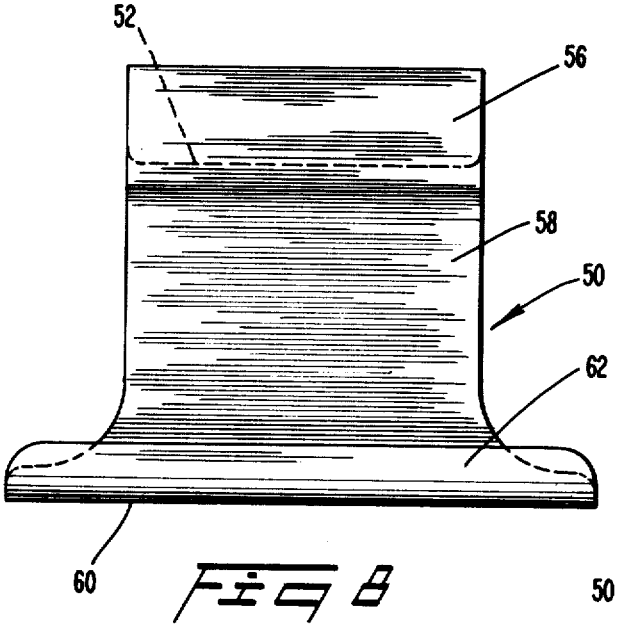
FIG. 8 is a front view of the casket shelf of FIG. 6.
Figure 9:
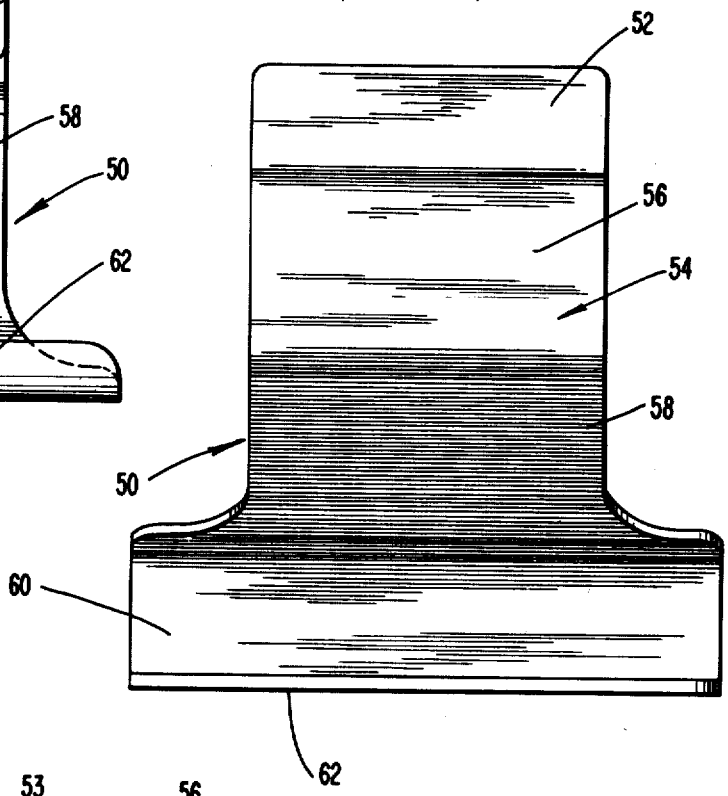
FIG. 9 is a plan view of the casket shelf of FIG. 6.
Figure 10:
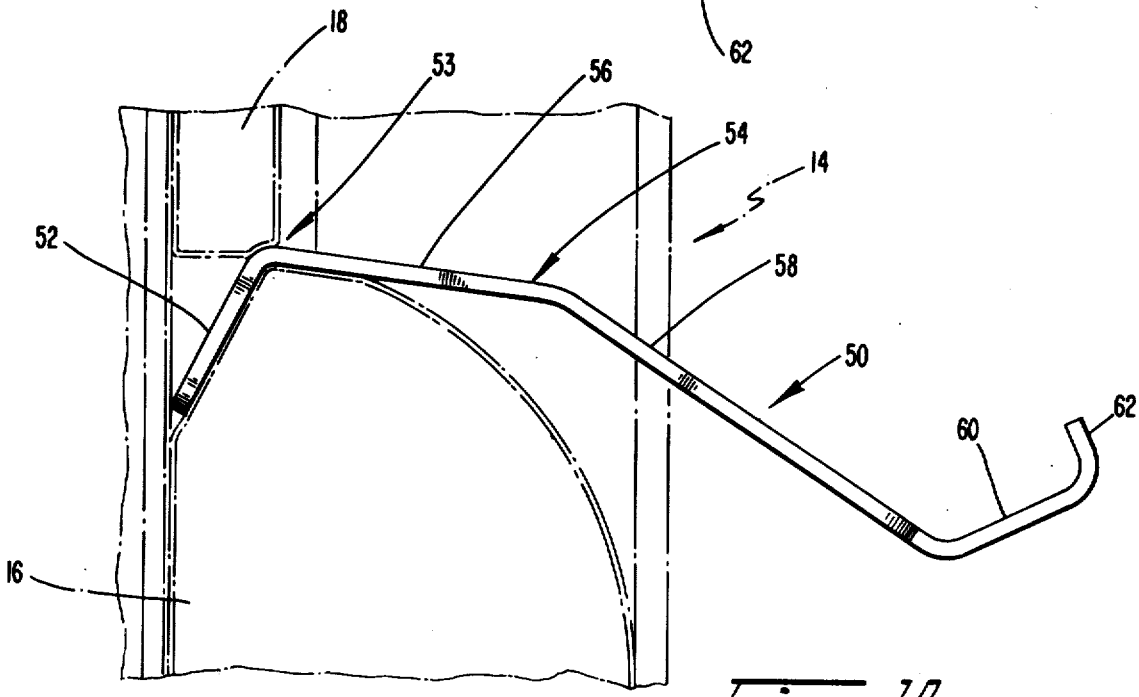
FIG. 10 is a view similar to FIG. 5, depicting the cantilever mounting of the shelf of FIG. 6.

The shelf comprises an exposed support portion 24, and a retaining portion 26. The exposed portion 24, which may assume various shapes, includes a support surface 28 such as a flat surface as depicted in FIG. 5.

The retaining portion 26 comprises a tab of less width than the width W' of the support portion. The tab 26 is shaped to be inserted into the seam to lie behind the stiff upholstery. The tab 26 is integral with the exposed portion 24 and extends at an angle slightly greater than ninety degrees, e.g., about 106 degrees, relative to that section of the exposed portion to which it is adjoined. The tab is arranged to extend generally vertically downwardly in its installed state so that the weight of the support article is counteracted as the tab bears against the inside of the casket lid 14. That is, the weight of the article imposes forces tending to swing the exposed support portion downwardly, which forces are opposed by the lid interior as the tab is urged rearwardly thereagainst.

The outer free edge of the exposed portion can have a reverse bend at 21, if desired.

To install the shelf 22, the exposed support portion 24 is grasped and manipulated so as to slip the tab 26 into the seam 20 and behind the frame 16. After the shelf 22 has been installed, the support surface 28 is oriented substantially horiozontally and is able to receive and support an article.

It will be appreciated that in accordance with the present invention, the exposed support portion may be inclined relative to horizontal. In that regard, attention is directed to an embodiment depicted in FIGS. 6–10, wherein a preferred shelf 50 includes a tab 52 which, when installed within a seam 53, lies behind the frame part 16 of the upholstery. The exposed portion 54 includes a first section 56 adjoining the tab, a second section 58 adjoining the first section, and a ledge 60 extending generally outwardly from a lower end of the section 58. The shelf is arranged to support a book, such as a bible for example, which sits on the ledge 60 and rests against the second section 58 and/or the upholstery. Forces imposed by the weight of the book are resisted by the inside surface of the lid as the tab 52 bears thereagainst. That is, the weight of the book tends to urge the exposed support portion downwardly. At the same time, the retaining tab 52 is urged rearwardly and bears against the inner surface of the casket lid.

The ledge 60 includes an upstanding lip 62 to aid in retention of the book.

It will be appreciated, then, that a shelf according to the present invention is easily attached to and detached from a standard type of casket structure, requiring no redesign of such casket.

The shelves may be formed of any material, such as clear plexiglas for example.

In lieu of inserting the retaining portion through a seam formed by adjacent upholstery parts, a unitary piece or stiff upholstery could be provided with a slit sized to receive the retaining portion. Also, the retaining tab could be oriented to extend in other directions, such as upwardly, as long as the stiff upholstery is capable of providing sufficient reinforcement.

In accordance with the present invention, articles, such as those having religious or personal significance, for example, can be placed within the casket itself, thereby creating a more intimate and less cluttered atmosphere. This can be achieved in a standard type of casket, requiring no redesign thereof.

Although the present invention has been described in connection with preferred embodiments thereof, it will be appreciated by those skilled in the art that additions, modifications, substitutions, and deletions may be made without departing from the spirit and scope of the invention, as defined in the appended claims.

What is claimed is:

1. A casket shelf in combination with a casket of the type including a container and a lid hinged thereto, the lid having stiff upholstery mounted on an inside surface of the lid, said upholstery forming a slit, said shelf being removably attached within said upholstery in cantilever fashion with the lid in an open condition, said shelf comprising an exposed support portion and a retaining portion; said support portion including a support surface for supporting an article, said retaining portion extending at an angle relative to a section of said support portion to which it is adjoined; said retaining portion extending downwardly through said slit and lying behind a section of said upholstery and being urged to bear against the lid under the weight of an article carried by said support surface.

2. The combination according to claim 1, wherein said retaining portion comprises a tab which is of shorter width than at least a portion of said support surface.

3. The combination according to claim 1, wherein said support surface is oriented substantially horizontally.

4. The combination according to claim 1, wherein said support surface is oriented at an angle relative to horizontal.

5. The combination according to claim 4, wherein said support surface includes relatively angled sections for supporting a book.

6. The combination according to claim 1, wherein said slit is defined by an interface between adjacent upholstery parts.

* * * * *